US007836744B2

(12) United States Patent
Hufenbach et al.

(10) Patent No.: US 7,836,744 B2
(45) Date of Patent: Nov. 23, 2010

(54) DIE FOR FORGING AT HIGH TEMPERATURES

(75) Inventors: Werner Hufenbach, Dresden (DE); Albert Langkamp, Dresden (DE); Peter Janschek, Duesseldorf (DE)

(73) Assignee: Leistritz Aktiengesellschaft, Nuremberg (DE)

( * ) Notice: Subject to any disclaimer, the term of this patent is extended or adjusted under 35 U.S.C. 154(b) by 83 days.

(21) Appl. No.: 11/881,067

(22) Filed: Jul. 25, 2007

(65) Prior Publication Data

US 2008/0072651 A1 Mar. 27, 2008

(30) Foreign Application Priority Data

Aug. 11, 2006 (DE) ..... 10 2006 037 883

(51) Int. Cl.
*B21D 37/16* (2006.01)

(52) U.S. Cl. ..... 72/342.8; 72/352; 72/462; 72/482.92

(58) Field of Classification Search ..... 72/342.8, 72/352, 353.2, 354.2, 360, 462, 476, 478, 72/482.92, 358, 364, 467, 342.1, 342.7, 357; 76/107.1; 29/447
See application file for complete search history.

(56) References Cited

U.S. PATENT DOCUMENTS 3,697,211 A * 10/1972 Chisholm ..... 425/191
3,833,982 A * 9/1974 Paulin ..... 29/895.21
3,987,658 A 10/1976 Herold
4,270,380 A * 6/1981 Gulati et al. ..... 72/467
4,530,229 A * 7/1985 Walker ..... 72/354.2
4,531,396 A 7/1985 MacNitt, Jr. et al.
4,984,445 A 1/1991 Ohuchi et al.
5,057,071 A * 10/1991 Piramoon ..... 494/16
5,113,686 A * 5/1992 Kawahara ..... 72/462
5,406,825 A * 4/1995 Horie et al. ..... 72/358
5,419,029 A * 5/1995 Raaijmakers ..... 29/447
5,964,120 A * 10/1999 Iwase et al. ..... 72/467
6,059,012 A * 5/2000 Vining et al. ..... 164/312
6,513,360 B1 * 2/2003 Ito et al. ..... 72/462
6,997,995 B2 2/2006 Janschek et al.

FOREIGN PATENT DOCUMENTS

DE 25 06 701 8/1976
DE 33 23 377 1/1984
DE 34 19 230 11/1984
DE 199 16 566 10/2000

(Continued)

OTHER PUBLICATIONS

Database WPI Derwent Publications Ltd./, London, GB; AN 1988-054963 XP002455227 -& SU 1 323 167 A (Perm Poly) Jul. 15, 1987 *Zusammenfassung*.

(Continued)

*Primary Examiner*—Edward Tolan
(74) *Attorney, Agent, or Firm*—Jordan and Hamburg LLP

(57) ABSTRACT

Die for high temperature forging of metal components, in particular intermetal components, including and upper an a lower die, characterized in that provided to each die part, at room temperature and with some clearance, is a surrounding reinforcing ring against which each die part is positioned when heated due to its thermal expansion and via which a compressive stress is exerted onto each die part (4).

25 Claims, 3 Drawing Sheets

FOREIGN PATENT DOCUMENTS

| | | |
|---|---|---|
| DE | 103 46 265 | 5/2005 |
| GB | 1 357 784 | 6/1974 |
| JP | 1-113145 | 5/1989 |
| JP | 6-106290 | 4/1994 |
| JP | 11-347677 | 12/1999 |
| WO | WO- 02/48420 | 6/2002 |

OTHER PUBLICATIONS

Database WPI Derwent Publications Ltd., London, GB; AN 1979-H06598 XP002455228 -& SU 631 248 A (Tulyankin V F) Nov. 5, 1978 *Zusammenfassung*.

* cited by examiner

DIE FOR FORGING AT HIGH TEMPERATURES

BACKGROUND OF THE INVENTION

The invention relates to a die for high temperature forging of metal components, in particular intermetal components, including an upper and a lower die.

In high temperature die forging, the blank is molded at temperatures greater than 1000° C.; when components made of intermetal compounds are molded, e.g. TiAl, the blank is even molded with temperatures of approx. 1150° C. on the tool. A molding method regarding such a component made of an intermetal compound is known for instance from WO 02/48420 A2. Normally components for conventional and air traffic technology, for instance for aircraft engines or stationary gas turbines, their vanes, which are very simple to build and can withstand heavy loads, are produced from such materials. Used as a die tool is a die made of a molybdenum alloy that is adequately heat resistant up to a tool temperature of 1150° C. However, this heat resistance is not enough to produce components with narrow dimensional tolerances, that is, it is only possible to produce overmeasure forged parts that must be further processed in a subsequent machining and/or electrochemical process. However, molding above the eutectic range in the α-γ phase area, that is at temperatures greater than 1200-1300° C. or more, has proved advantageous. In this range it is possible to produce components that have significantly greater dimensional precision. However, since a die made of a molybdenum alloy cannot be used in this temperature range, in this case dies made of ceramics are used that have for instance a carbon or silicon basis. However, it is disadvantageous that these die materials are extremely sensitive to tensile stresses that naturally occur when forging dies, so that the durability of such dies is only limited.

The underlying problem of the invention is therefore to provide a die that can be used for high-temperature forging at temperatures ranging from more than 1200° C. to at least 1300° C., and that has adequate stability in terms of stresses that occur during die forging, in particular tensile stresses.

SUMMARY OF THE INVENTION

For solving this problem, it is inventively provided in a die of the type cited in the foregoing that provided to each die part, at room temperature and with some clearance, is a surrounding reinforcing ring against which each die part is positioned when heated due to its thermal expansion and via which a compressive stress is exerted onto each die part.

Each inventive die part possesses a special reinforcing ring that surrounds it and that at room temperature, that is, when the die is not arranged in the press and is heated to operating temperature, surrounds the die part with some clearance. The clearance is for instance one millimeter. This permits the die part and the reinforcing ring to be separated at room temperature, which may be necessary when the die part is exchanged for a different die part with a different engraving. If the die part/reinforcing ring combination is now heated, the die part expands significantly more than the reinforcing ring, depending on what material or material compound the ring is made of, whereby it may have even have a negligible expansion. The expansion of the die part, caused by the heat, now leads to the fact that the die part is positioned securely against the surrounding reinforcing ring. This itself leads to the fact that the reinforcing ring exerts compressive stresses onto the die part, which stresses counteract or work against the tensile stress that occurs during forging. Thus an intentional decrease in stress is the result, and its consequence is a significantly longer life for the die part.

In a further development of the invention, the clearance at room temperature is preferably designed taking into account the expansion behavior of each die part and where necessary of the reinforcing ring so the latter exhibits a certain expansion behavior such that the compressive stress that has built up assumes a pre-specified value at the forging temperature. Thus, using suitable dimensioning and taking into account the specific material parameters of the die part material and also of the reinforcing ring, it is possible to very precisely adjust the amount of the compressive stress that has built up. Since the tensile stresses that occur during forging can also be determined relatively precisely, it is consequently possible to design the die part and also the reinforcing ring appropriately with respect to the clearance at room temperature so that it is to a large extent possible to compensate the tensile stresses that build up during forging.

The die parts themselves are made of ceramic or graphite, and where necessary are particle-reinforced or fiber-reinforced. These materials withstand the high forging temperatures that are required for forging in the temperature range above the eutectic in the α-γ phase area, without anything further, and as a result of the inventive use of the reinforcing ring can be used for high-temperature forging.

The reinforcing ring itself inventively comprises a fiber composite material, in particular carbon fibers, that are wound about a core during production. Carbon fibers in the fiber direction possess an extremely low coefficient of thermal expansion, sometimes even a negative coefficient of thermal expansion. When the fiber is wound appropriately or oriented appropriately about the core, a reinforcing ring can be produced as a wound reinforcing structure that when heated exhibits nearly no expansion. One advantageous further development of the invention provides that the reinforcing ring has a hybrid structure and has an interior bearing ring against which the heated die part is positioned. That is, the reinforcing ring in this case compresses the exterior reinforcing ring section made of wound carbon fibers and an interior bearing ring against which the heated die part is positioned. This interior bearing ring, which inventively comprises a textile structure, in particular a fabric or weave made of plastic fibers, and is wound about a core, permits a relatively high degree of shaping options and freedom in configuration with regard to the design of the reinforcing ring. Because in the exterior reinforcing ring section made of wound carbon fibers it is difficult to integrate or shape corresponding geometries that deviate from the pure cylinder shape, or for instance to embody them in the shape of bores or the like, since the strength or mechanical properties are significantly worse perpendicular to the longitudinal direction of the fiber or to the winding structure. This is accounted for in that the interior bearing ring is provided and has low reinforcing or compressive stress-producing properties, but rather primarily enables structural or geometric characteristics. For this, during production a textile structure in the form of a fabric or weave is wound about the core of the bearing ring, that is, there is no pronounced fiber direction. The use of this textile structure now makes it possible to embody for instance projections or undercuts or the like or to apply to appropriate sections bores or the like that are also always required for certain reasons.

As described, at room temperature the reinforcing ring surrounds the die part, which can be a single piece or multiple parts (which will be discussed in greater detail in the following) with a slight clearance. In order to prevent the die part from falling out of the reinforcing ring when the die part/reinforcing ring combination is being transported, preferably one or more radially inwardly directed projections, preferably in the form of an edge running circumferentially around at least 180°, are provided that retain the inserted die part. The die part is disposed on this projection and, fixed via the projection, and when there is some clearance by a slight tilt towards the interior bearing ring, cannot fall out of the reinforcing ring.

If the die is provided for use in a cold-hot process technology in which the die is taken out of the press and loaded, whereupon it is transported back to the press and heated and after the pressing process is again removed from the press, the interior bearing ring is also cylindrical in terms of its basic shape. It is open on both sides so that the die part is positioned with its side that opposes the engraving flat and directly on the pressure ram. An inventive die can also be used for use in the framework of a pure heat process technology, however. In this case, the die remains in the press, that is, the two individual die parts are securely connected to the pressure ram. In order to enable a connection, in a die that is suitable for such use the bearing ring is inventively closed on one side, at least section-wise. Thus, the bearing ring has on one side, against which side the engraving-free side of the die part is positioned, a closed surface, at least section-wise, in which corresponding bores or the like can be provided and via which it is possible to fix the bearing ring and via the latter to fix the reinforcing ring in addition to the die part on the base of the pressure ram.

So that the die parts can also be moved into the pressing position in the correct position relative to one another, usefully provided at both die parts when the die parts are placed together are cooperating restricted guidance elements that preferably include one or a plurality of bolts or pins that engage(s) the bolt or pin receiving elements on the opposing die part. When using two bolts or pins, for example, both bolts or pins do not absolutely have to be on the same die part. It is also conceivable to provide one bolt on each die part and a corresponding receiving element opposite thereto on the other die part. These bolts or pins are also preferably made of graphite or ceramics, where necessary also fiber-reinforced or textile-reinforced, primarily using carbon fibers.

As already described, it is possible to embody a die part in one piece or to put it together from two or more individual die part elements. This is necessary when undercuts or the like must be molded on the forged part in order to open the die part and to be able to mold the forged part. If they are used in the reinforcing ring, the two or more die parts are inserted such that each die part element is positioned against a or the projection that retains it and that is on the interior ring, and a corresponding undercut that engages in the projection may be embodied on the die part or die part element. At room temperature, the die part elements also have a certain amount of clearance to one another so that the individual die part elements can be arranged or fitted inside the reinforcing ring with nothing further.

Furthermore, it is useful when the die part or the die part elements are connected to the reinforcing ring via at least one retaining element. This retaining element, which has a certain fixing function like the projection or the projections, also guides the components relative to one another during the radial expansion movement caused by the heat. Such a retaining element is preferably a retaining pin that is received in corresponding receiving elements on the reinforcing ring and on the die part or a die part element.

Finally, each die part can have either one individual engraving or even a plurality of engravings, depending on the type and size of the forged part to be produced.

Additional advantages, features, and characteristics of the invention result from the exemplary embodiments described in the following and using the drawings.

DETAIL DESCRIPTION OF THE INVENTION

Figure 1:
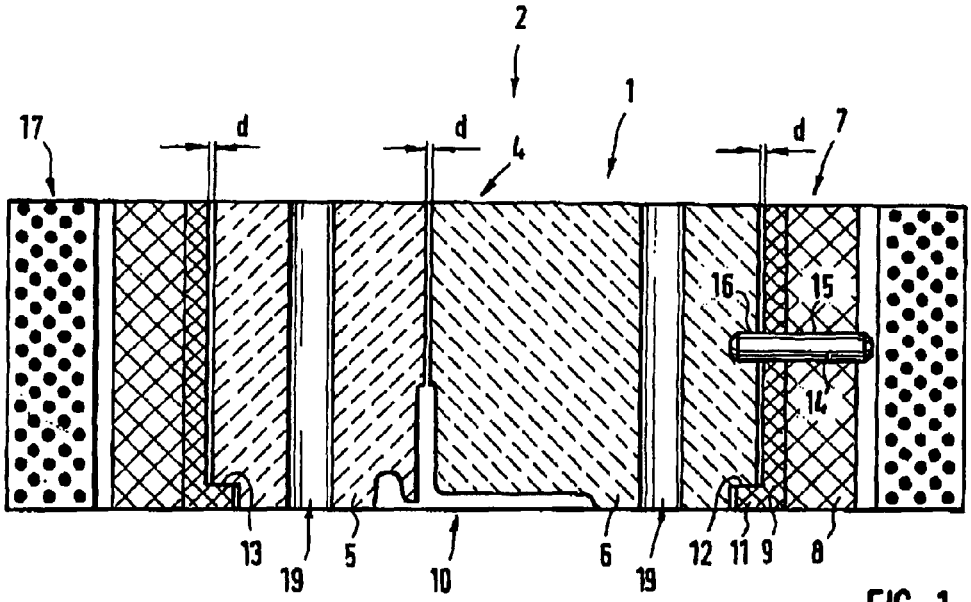
FIG. 1 is a sectional view through an inventive upper die of a first embodiment.
Figure 2:
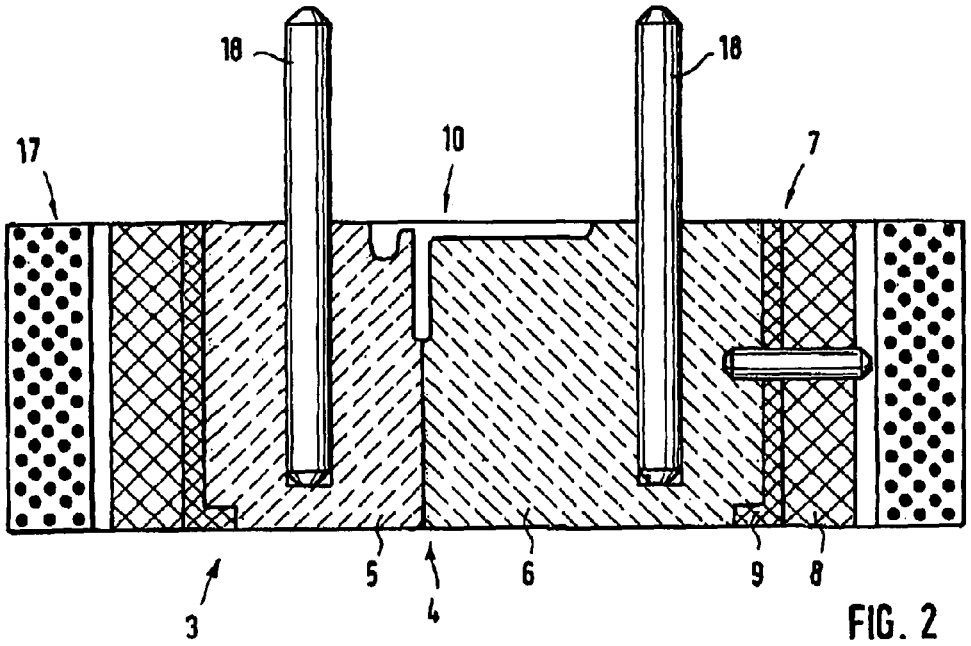
FIG. 2 is a sectional view through the associated lower die.
Figure 3:
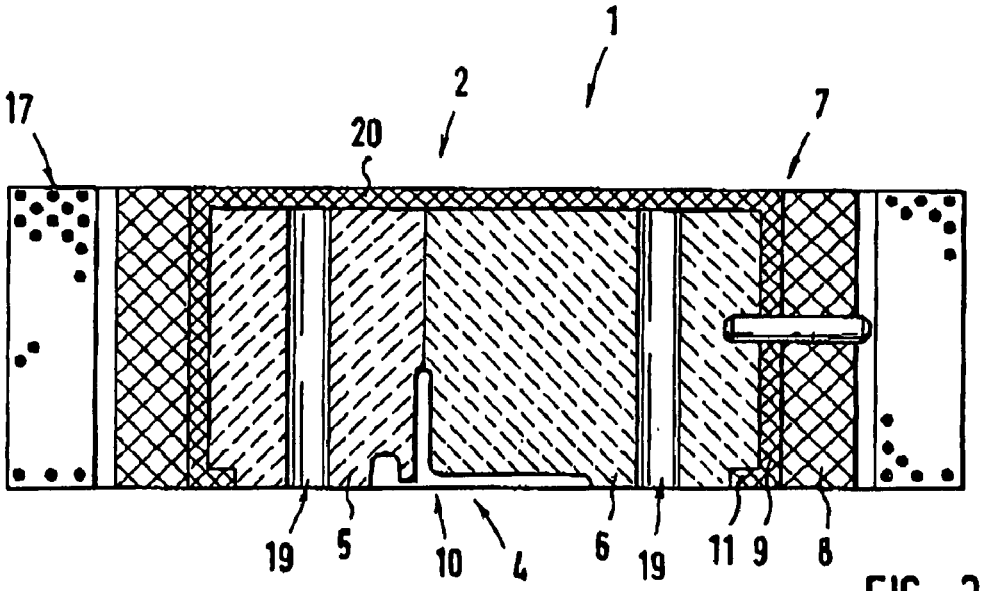
FIG. 3 is a sectional view through an upper die of an inventive second embodiment.

FIG. 1 depicts the upper part 1 of an inventive die 2, while FIG. 2 depicts the lower part 3. The upper part 2 comprises a die part 4, in this case comprising two die part elements 5, 6. The upper part 2 furthermore has a reinforcing ring 7 comprising the exterior reinforcing ring part 8 and an interior bearing ring 9. The die part 4 comprising the two die part elements 5, 6 has at its compression side a mold cavity 10 that molds a molded part that is to be produced during high temperature die forging. FIG. 1 depicts the upper die 2 at room temperature, while FIG. 3 depicts the lower die at an operating temperature of 1200° C. or more.

As can be seen from FIG. 1, the die part 4 has a small amount of clearance to the reinforcing ring 7, in this case the cylindrical interior wall of the bearing ring 9, which clearance is depicted by the narrow gap having the width d, whereby $d \leqq 1$ mm. The two die part elements 5, 6 also have a small amount of clearance relative to one another, which is also depicted by the indicated distance d, whereby the clearance does not have to equal the clearance to the bearing ring. In each case the die part elements 5, 6 sit loosely in the reinforcing ring 7 when this combination is at room temperature.

So that the die part elements 4 placed in the bearing ring 7 do not fall downward out of the reinforcing ring 7 when the upper part is being manipulated, the interior bearing ring 9 has a projection 11 that is inwardly oriented and is in the form of a retaining flange that runs circumferentially either 360° or at least 180°. The die part elements 5, 6 are disposed thereupon on their edges; they have corresponding undercuts 12, 13 into which the edge of the projection 11 engages. Moreover, a guide pin 14 is provided that passes through a bore 15 through the bearing ring 7 and engages in an insertion bore 16 of one die part element, in this case the die part element 6. This guide pin, which also has a certain retention or bearing function, primarily provides radial guidance for the die part element during the expansion process, which will be described in greater detail in the following.

The die part elements 5, 6 are preferably made of ceramic or a ceramic matrix composite material of any type that is selected such that it can be used at forging temperatures greater than 1200° C., whereby an inventive die can be used even at temperatures ranging from 1500-2000° C.

As described, the reinforcing ring 7 is itself a hybrid constructed from the exterior reinforcing ring part 8 and the interior bearing ring 9. The exterior reinforcing ring part 9 comprises a ring made of carbon fiber composite material. The longitudinal direction of the fibers is oriented appropriately for producing compressive stresses in the heated upper part 2 that are exerted on the die part 4 in order to counteract any tensile stresses that build up in the die part 4 during forging and that are primarily radial. The reinforcing ring part 8 has an extremely low coefficient of thermal expansion, possibly even a negative coefficient of thermal expansion, in the longitudinal direction of the fiber, depending on the carbon fiber material used, which leads to the fact that when heated it demonstrates almost no thermal expansion.

In contrast, the interior ring 9 likewise comprises a ring made of carbon fiber composite material having a reinforcing structure, preferably a fabric or weave made of carbon fibers, so that a textile bearing structure results, different from the winding fibers in the reinforcing ring part 8 that are all oriented exactly the same. Using a fiber fabric or weave makes it possible to configure different geometric shapes, for instance about a flange or projection 11 that projects inward on the interior ring. This is not possible when using individually placed fibers as they are wound in the exterior ring part 8 without a negative impact on mechanical properties. Consequently the interior ring 9 does not fulfill a stress producing function and thus the reinforcing function, the function of building compressive stress, is assumed solely by the exterior reinforcing ring part 8. The interior bearing ring primarily has the function of providing any geometric shapes and configurations that are necessary, as in this case, for instance for positioning the die part elements.

If an induction heater 17, in which the upper part 2 is disposed in accordance with FIG. 1, is now used to heat the upper part 2, the die part 4 or the die part elements 5, 6 expand primarily radially because of the heat depending on the coefficients of thermal expansion of the graphite or ceramic material. Because of this, as the expansion progresses the gap between the die part elements 5, 6 and also to the bearing ring 9 are closed. The greater the expansion, the more tightly the die part 4 is positioned radially against the reinforcing ring 7. Since the reinforcing ring 7 or the exterior reinforcing ring part 8 does not expand or expands only slightly despite the extremely high temperature, but due to its own expansion the die part 4 is pressed tightly against the die part 4, high compressive stresses are induced in the die part 4 via the reinforcing ring 7. These compressive stresses now counteract the tensile stresses that occur during forging. The gap or clearance d is designed taking into account the coefficients of thermal expansion for the materials used in the die part and also in the reinforcing ring 7, in this case in particular the reinforcing ring part 8 so that at the working temperature the induced compressive stresses attain a predetermined value. Since it is possible to be able to determine the tensile stresses occurring in the die part 4 during forging, and their direction, it is thus possible to design the clearance with respect to the operating temperature such that the compressive stresses produced largely compensate the tensile stresses caused by the pressing.

FIG. 2 depicts the lower part 3, the die part 4 of which also comprises two die part elements 5, 6 that are received in a reinforcing ring 7 comprising the exterior reinforcing ring part 8 and the interior bearing ring 9. In this case, however, the lower part 3 is already heated to operating temperature or to just slightly below operating temperature via the induction heater 17. As can be seen, the gaps d that are still present at room temperature (see FIG. 1) are all closed.

The die 1 in accordance with FIGS. 1 and 2 is provided primarily for cold-hot processing technology. The die thus does not have any solid connection to the molding machine.

It is assembled outside of the machine, that is, it is assembled at room temperature and provided with a blank that is placed in the engraving 10 and that can be cold or preheated. Then the two die elements, that is the upper part 2 and the lower part 3, are added to the pressure chamber through a suitable lock, the pressure chamber being in a vacuum or under protective gas to prevent oxidation. In the pressure chamber, the upper part 2 and the lower part 3 are heated to the required molding temperature of for instance 1200-1300° C., either inductively (as shown in the figures) or using radiant heat. After attaining the forging temperature, the die 1 is brought between the press plates of the molding press, which are also at this temperature, and the molding process for molding the blank is performed at the required slow speed. Then the die is cooled with the shaped component under protective gas after being removed from the shaping press and is taken out via the lock, whereupon the component is removed and a new component is added.

In order to ensure that the upper part 2 and the lower part 3 can also be moved correctly relative to one another, in the example depicted a restricted guidance element is provided, in the example depicted comprising two bolts 18 that in this case are received on the lower part in corresponding bolt receiving elements. Corresponding bolt guides 19 are provided on the upper part, and the bolts 18 enter and are guided therein when the die tools are put together. The bolts 18 preferably also comprise graphite or another suitable ceramic material; they can also be textile-reinforced or fiber-reinforced.

Figure 4:
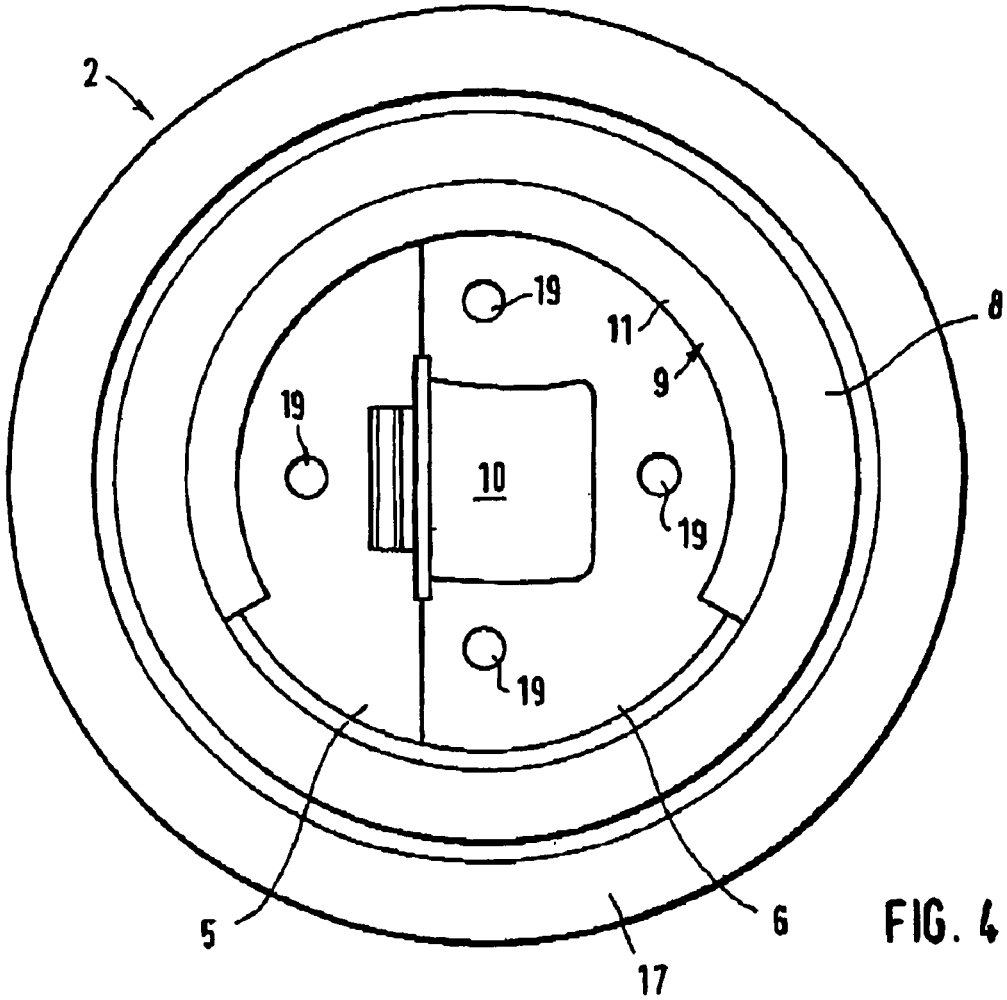
FIG. 4 is a view onto the upper die from FIG. 3, looking at the side with the engraving.
Figure 5:
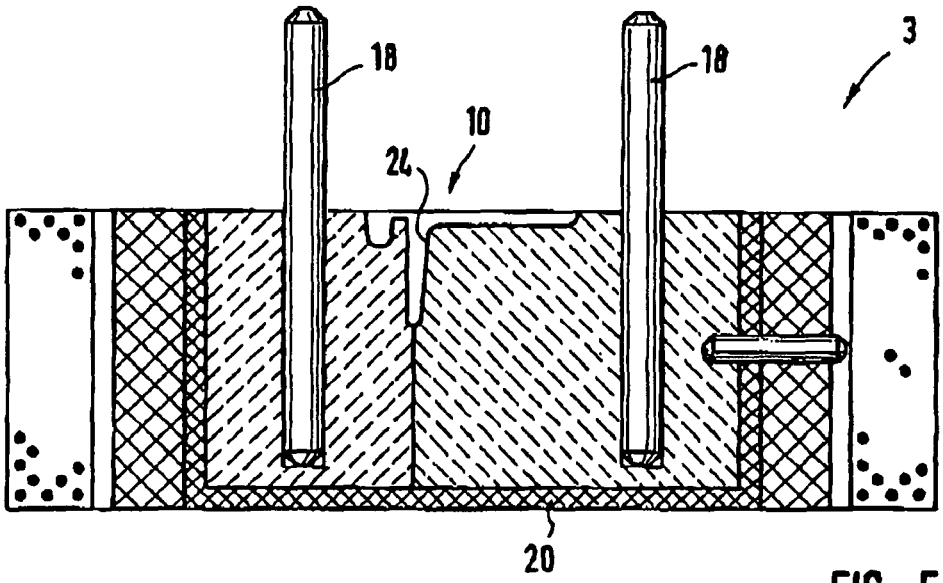
FIG. 5 is the associated lower die.

FIGS. 3-5 depict another embodiment of an inventive die 1, likewise comprising an upper part 2, depicted in FIG. 3, and a lower part 3, depicted in FIG. 5. Both possess a die part 4 comprising two die part elements 5, 6 that are received in a reinforcing ring 7, likewise comprising an exterior reinforcing ring part 8 and an interior bearing ring 9. In this case, as well, all elements at room temperature are arranged with clearance to one another, as was described for FIG. 1. For the sake of simplicity, however, the two die tools in FIGS. 3 and 5 are depicted as if they have already been heated, so that the die part 4 has expanded completely, is positioned tight against the reinforcing ring 7, and through it compressive stress is induced in the die part 4.

In the exemplary embodiment described there, however, the interior bearing ring 9 is embodied somewhat differently than the bearing ring 9 in the exemplary embodiment in accordance with FIGS. 1 and 2. While in this case the one radially inwardly directed projection 11 is provided on the one bearing ring side, the other side of the bearing ring 9 is completely closed, that is, an upper base plate is provided (in FIG. 3) and a lower base plate 20 is provided (in FIG. 5). Now the entire upper part 2 or lower part 3 can be attached to the corresponding press plates via this base plate 20. For this, even if not shown in greater detail, corresponding through-passages are provided on each base plate 20 for receiving connecting screws or the like that enable fixation. The die illustrated in FIGS. 3, 4, 5 is a die that is designed for a hot process technology, that is, the upper and lower parts 2, 3 always remain in the shaping press and are not removed; the only thing removed is the shaped pressed part. That is, the upper and lower parts 2, 3 remain at the working temperature continuously. In contrast to the engraving 10 from FIG. 2, for shaping in this case the engraving 10 is provided on the lower part in a section with a draft angle 24 that is at a slight angle $\alpha$ to the vertical, different from the engraving 10 in FIG. 2, which runs vertically in this section. When separating the tool parts, which in this case as well are restrictively guided to one another via the restricted guidance via the bolts 18 and the bolt guides 19, the forged component remains in the upper part 2. For removing the pressed part from the upper part, the latter is cooled until the gap between the die part elements 5, 6 opens slightly and the weight of the forged part causes it to fall out of the upper part and it can be removed from the die using a simple manipulator.

FIG. 4 depicts a view of the bottom with the engraving 10 of the upper part from FIG. 3. As can be seen, the projection 11 only runs about 240° around the interior bearing ring 8 of the reinforcing ring 7. This makes it possible to place the two die part elements 5, 6 into the somewhat pot-shaped bearing ring 9 that is closed on the other side. Likewise, the two die part elements 5, 6, even if as embodied they have at room temperature some clearance relative to one another and also to the reinforcing ring, are guided with certainty such that they cannot be lost. Furthermore, FIG. 4 depicts that in this exemplary embodiment a total of four bolt through-passages 19 are provided, that is four bolts 18 are also provided on the lower part, even if only two are illustrated in FIG. 5.

Figure 6:
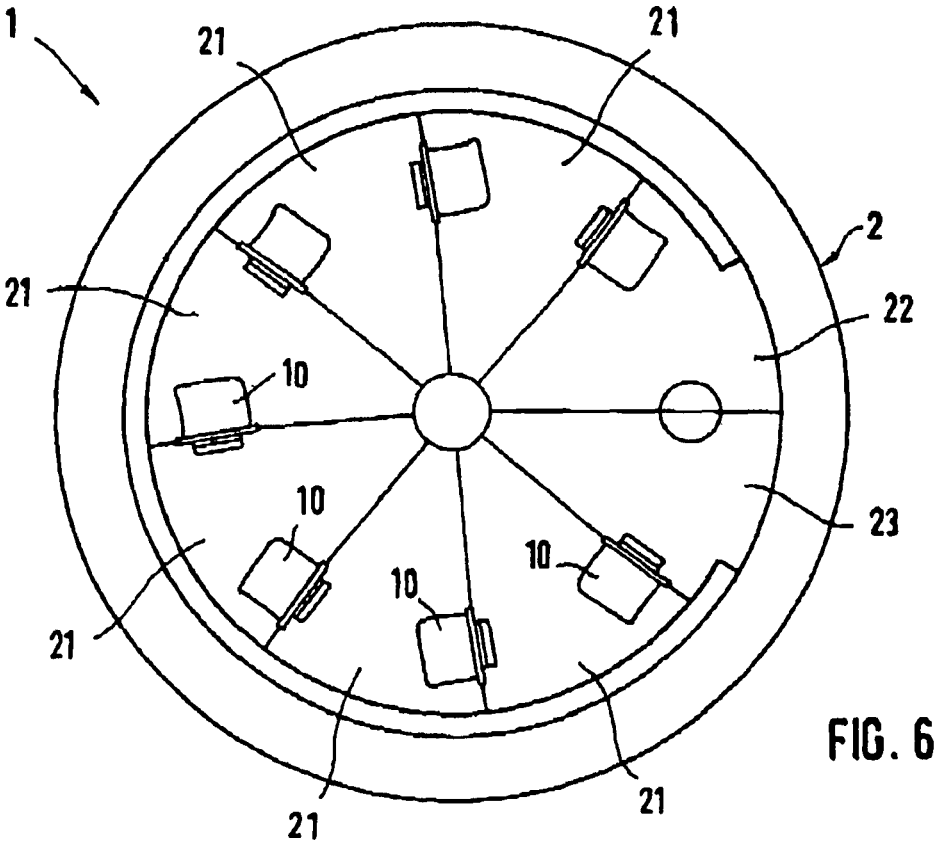
FIG. 6 is a view onto a die in a third embodiment having a plurality of engravings.

Finally, FIG. 6 depicts another exemplary embodiment of a die 1, only the upper part 2 being depicted. This upper part 2, and naturally the lower part in a similar manner, comprises a total of eight individual die part elements, the die part elements 21 all being embodied the same, only the two die part elements 22 and 23 being embodied differently in terms of their shape and with regard to the engraving present. In any case here there is a total of seven engravings 10, in contrast to the exemplary embodiments described in the foregoing, each of which has one engraving. In this case, as well, the separating line between the die part elements 21, 22, 23 run such that when the die part elements are separated from one another the engraving is opened, as is also the case for the die part elements 5, 6 of the exemplary embodiments in accordance with FIGS. 1 and 2 or 3-5. That is, when the die part is opened, the engraving also opens automatically.

The invention claimed is:

1. A die for high temperature forging of metal components, comprising:

an upper die part and a lower die part each comprising ceramic or graphite; and a reinforcing ring comprising a fiber composite material with wound fibers surrounding each of said upper and lower die parts, there being a clearance between said reinforcing ring and each of said upper and lower die parts at room temperature, said clearance being dimensioned to account for a thermal expansion behavior of each of said upper and lower die parts and said reinforcing ring such that, when said upper die part, said lower die part and said reinforcing ring are heated to a forging temperature of greater than 1200° C., compressive stresses are produced by said upper and lower die parts being pressed against said reinforcing ring at said forging temperature which largely compensate tensile stresses created during forging.

2. A die according to claim 1, wherein said metal components include intermetal components.

3. A die according to claim 1, wherein said upper and lower die parts are particle-reinforced or fiber-reinforced.

4. A die according to claim 1, wherein said reinforcing ring comprises wound carbon fibers.

5. A die according to claim 4, wherein said reinforcing ring includes an interior bearing ring against which each of said upper and lower die parts is positioned when heated.

6. A die according to claim 5, wherein said interior bearing ring comprises a wound textile structure.

7. A die according to claim 6, wherein said a wound textile structure includes a fabric or weave made of carbon fibers.

8. A die according to claim 5, wherein said interior bearing ring includes one or more projections that hold each of said upper and lower die parts on said interior bearing ring when inserted therein.

9. A die according to claim 8, wherein said one or more projections include an edge projection running circumferentially around at least 180°.

10. A die according to claim 5, wherein said bearing ring is closed, at least section-wise, on one side.

11. A die according to claim 1, wherein said upper and lower die parts include restricted guidance elements which mutually cooperate when said die parts are placed together.

12. A die according to claim 11, wherein said restricted guidance elements include at least one bolt or pin on one of said upper and lower die parts that engage in at least one respective bolt receiving element on an opposing one of said upper and lower die parts.

13. A die according to claim 12, wherein said at least one bolt or pin comprises graphite or ceramic.

14. A die according to claim 13, wherein said at least one bolt or pin is fiber-reinforced or textile-reinforced.

15. A die according to claim 1, wherein at least one of said upper and lower die parts comprises two or more individual die part elements.

16. A die according to claim 15, wherein at room temperature said die part elements have some clearance relative to one another therebetween.

17. A die according to claim 1, wherein each of said upper and lower die parts is connected to said reinforcing ring via at least one retaining element.

18. A die according to claim 15, wherein each of said die part elements is connected to said reinforcing ring via at least one retaining element.

19. A die according to claim 17, wherein said at least one retaining element includes at least one retaining pin that is received in at least one corresponding receiving element on said reinforcing ring and on said die part.

20. A die according to claim 18, wherein said at least one retaining element includes at least one retaining pin that is received in at least one corresponding receiving element on said reinforcing ring and on said die part elements.

21. A die according to claim 1, wherein each of said upper and lower die parts includes engravings.

22. A die for high temperature forging of metal components, comprising:

an upper die part and a lower die part each comprising a ceramic, ceramic matrix composite or graphite material of a type suitable for use at a forging temperature greater than 1200° C.; and a reinforcing ring surrounding each of said upper and lower die parts, said reinforcing ring comprising a fiber composite material with wound carbon fibers, said reinforcing ring being configured such that a clearance between said reinforcing ring and each of said upper and lower die parts is present at room temperature, said clearance being dimensioned to account for a thermal expansion behavior of each of said upper and lower die parts and said reinforcing ring such that, when said upper and lower die parts and said reinforcing ring are heated to the forging temperature greater than 1200° C., compressive stresses are produced by said upper and lower die parts being pressed against said reinforcing ring at said forging temperature which largely compensate tensile stresses created during forging.

23. A die according to claim 22, wherein the reinforcing ring has a hybrid structure including an exterior reinforcing ring part comprising the wound carbon fibers and an interior bearing ring comprising a textile structure.

24. A die according to claim 23, wherein the textile structure of said interior bearing ring comprises a fabric or weave made of plastic fibers.

25. A die according to claim 22, wherein the interior bearing ring includes a radially inward extending retaining flange.

* * * * *